US008218731B2

(12) United States Patent
Gillett

(10) Patent No.: US 8,218,731 B2
(45) Date of Patent: Jul. 10, 2012

(54) FILTERING OF A SOURCE OF PULSED RADIATION

(75) Inventor: Nicholas Danvers Penrose Gillett, Redondo Beach, CA (US)

(73) Assignee: L-3 Communication Security and Detection Systems, Inc., Woburn, MA (US)

( * ) Notice: Subject to any disclaimer, the term of this patent is extended or adjusted under 35 U.S.C. 154(b) by 223 days.

(21) Appl. No.: 12/774,838

(22) Filed: May 6, 2010

(65) Prior Publication Data

US 2010/0296631 A1 Nov. 25, 2010

Related U.S. Application Data

(60) Provisional application No. 61/180,490, filed on May 22, 2009.

(51) Int. Cl.
*G21K 3/00* (2006.01)

(52) U.S. Cl. ..... 378/158

(58) Field of Classification Search ..... 378/62, 378/145, 158–160
See application file for complete search history.

(56) References Cited

U.S. PATENT DOCUMENTS

| | | | | |
|---|---|---|---|---|
| 4,329,654 | A | 5/1982 | Chamberlain | 3/500 |
| 4,727,561 | A * | 2/1988 | Fujisaki | 378/54 |
| 5,081,660 | A * | 1/1992 | Fujisaki | 378/156 |
| 7,580,505 | B2 | 8/2009 | Kang et al. | 378/57 |
| 7,742,568 | B2 | 6/2010 | Smith | 378/98.11 |
| 2002/0094059 | A1 | 7/2002 | Grodzins | 378/57 |
| 2003/0016790 | A1 | 1/2003 | Grodzins et al. | 378/147 |
| 2004/0264628 | A1 | 12/2004 | Besson | 378/5 |
| 2007/0018117 | A1 | 1/2007 | Calderon et al. | 250/492.1 |
| 2007/0241282 | A1 | 10/2007 | Clayton et al. | 250/358.1 |
| 2008/0211431 | A1 | 9/2008 | Mishin et al. | 315/505 |
| 2009/0279664 | A1 | 11/2009 | McNabb et al. | 378/62 |

OTHER PUBLICATIONS

International Search Report and Written Opinion for corresponding International Application No. PCT/US2010/033871, mailed Jul. 2, 2010, 7 pages.

* cited by examiner

*Primary Examiner* — Courtney Thomas
(74) *Attorney, Agent, or Firm* — Fish & Richardson P.C.

(57) ABSTRACT

A source of pulsed radiation is coupled to a positionable filter. The positionable filter includes an element that produces an indication of a position of the filter. The source is configured to receive the indication of the position of the filter, and to regulate emission of a pulse of radiation based on the indication. A device includes an area including a material that alters a parameter of a beam of radiation that interacts with the material. The device is configured to move relative to a source of pulsed radiation. An element provides a signal to the source of pulsed radiation that indicates a position of the area relative to the source. The signal causes the source to trigger emission of a pulse at a time such that the emitted pulse is incident upon a portion of the area.

23 Claims, 3 Drawing Sheets

FILTERING OF A SOURCE OF PULSED RADIATION

CROSS-REFERENCE TO RELATED APPLICATION

This application claims the benefit of U.S. Provisional Application No. 61/180,490, filed May 22, 2009 and titled FILTERING OF A PULSED X-RAY SOURCE, which is incorporated by reference in its entirety.

TECHNICAL FIELD

This disclosure relates to filtering a source of pulsed radiation.

BACKGROUND

X-ray radiation emitted from an x-ray source may be filtered to modify the spectral output of the x-ray source. A first filter may be used to filter x-rays having a peak energy within a first range and a second filter may be used to filter x-rays having a peak energy within a second range. These filters are selected in a predetermined manner such that the first and second filters are always used to filter x-rays having the first and second peak energies, respectively.

SUMMARY

A source of radiation may be synchronized to a moving, rotatable, and/or positionable filter wheel to allow for selection of a particular filter from among many filers included in the wheel. In some implementations, the filter wheel rotates about an axis of rotation and a measurement of the angular position of the filter wheel is used to trigger the source. The angular position of the filter wheel provides an indication of a position of the filter wheel and/or the various filters included in the filter wheel such that the source emits a pulse of radiation at a time at which a section of the filter wheel that includes the desired filtering material is in the path of a pulse emitted from the source.

Accordingly, knowledge of the position of the filter wheel together with triggering emission of the pulse from the source based on that position allows selection of a particular filtering material from among several materials included in the filter wheel. As a result, a range of filters may be introduced into the beam emitted from the source, and the filters may change between pulses.

Some prior systems apply a particular filter to a beam of radiation or a pulse of radiation depending on the energy of the radiation in a predetermined and fixed manner. In contrast, the techniques discussed below allow a pulse to be filtered by a particular filter that is selected by triggering the source to emit the pulse when the particular filter is present, or will be present, in the path of the pulse and without regard to energy of the pulse, a state of the source, or other predetermined criteria. Accordingly, the present system allows an amount of filtering to be selectively varied in real-time, or near real-time, to accommodate, for example, changes in density of an object imaged by the system. As a result, a source that emits radiation having a single peak energy and energy spectrum may be used to image an object with varying density or to image multiple objects that have a range of densities.

In one general aspect, a system includes a source of pulsed radiation, and a positionable filter coupled to the source of pulsed radiation. The positionable filter includes an element that produces an indication of a position of the filter. The source is configured to receive the indication of the position of the filter, and the source is configured to regulate emission of a pulse of radiation based on the indication.

Implementations may include one or more of the following features. The filter may include a portion that includes a material that causes alteration of one or more of a flux, energy spectrum, position, or collimation of a beam of radiation that interacts with the material. The portion may include a plurality of sections, at least one of which includes the material. At least one of the plurality of sections may be a blank section without the material such that a beam of radiation is unaltered as a result of interacting with the blank section. At least one section of the plurality of portions may include a second material different from the material.

The source of pulsed radiation may be a linear accelerator. The source of pulsed radiation may regulate emission of the pulse of radiation by determining a particular time to emit the pulse of radiation. The positionable filter may rotate about an axis of rotation such that a pulse emitted from the source strikes one of the plurality of sections at a particular time. The source of pulsed radiation may regulate emission of the pulse of radiation by delaying emission of the pulse of radiation such that the emitted pulse strikes a selected one of the plurality of sections.

In another general aspect, a device, configured to move relative to a source of pulsed radiation, includes an area including a material that alters a parameter of a beam of radiation that interacts with the material. An element provides a signal to the source of pulsed radiation indicating a position of the area relative to the source. The signal causes the source to trigger emission of a pulse at a time such that the emitted pulse is incident upon a portion of the area.

Implementations may include one or more of the following features. The device may be configured to rotate about an axis of rotation, and the indication of a position of the device may include an indication of an angular position of the device relative to the axis of rotation. The device may include a cylindrically shaped element that defines a longitudinal axis that is parallel to the axis of rotation. The cylindrically shaped element may include a first end and a second end, and the portion including the material may be oriented between the first and second ends and along the longitudinal axis. The portion including a material may include a plurality of sections, at least one of which is a blank section that does not include a material such that an emitted pulse is unaltered by interaction with the blank section.

In some implementations, the signal provided by the element may cause the source to delay the emission of the pulse such that the pulse is emitted when a selected one of the plurality of sections is in a path of the emitted pulse. The signal may be sufficient to cause the source to alter a timing of the emission of the pulse from the source.

In another general aspect, a method of filtering a pulse includes accessing a position of a movable filter that includes a plurality of sections. Each section is associated with a filtering characteristic. The method includes selecting, from among the plurality of sections, a particular section for filtering by triggering a radiation source, based on the position of the movable filter, to generate a pulse that strikes the particular section of the movable filter.

Implementations may include one or more of the following features. Selecting a section from among the plurality of sections may include selecting a section associated with a filtering characteristic that does not alter a parameter of the pulse. Accessing a position of the movable filter may include receiving an indication of the position of the movable filter generated by the movable filter. The movable filter may rotate about an axis of rotation, and accessing a position of the movable filter may include receiving an angular position of the filter. The particular section may be selected independently of an energy output of from source.

In another general aspect, a machine readable medium coupled to an electronic processor, includes instructions that, when executed, cause the processor to perform operations including accessing a position of a moving filter that includes a plurality of sections, each section associated with a filtering characteristic, determining, based on the position, a time at which a particular one of the plurality of sections is in the path of a pulsed radiation source, and generating a signal sufficient to cause the source to emit a pulse such that the pulse strikes the particular one of the plurality of sections.

Implementations may include one or more of the following features. The signal may be provided to the source. The filter may rotate about a longitudinal axis defined by the filter, and a position of the filter may be accessed by receiving an indication of an angular position of the filter relative to the longitudinal axis.

In another general aspect, a timing of a sequence of pulses generated by a pulsed x-ray source is altered such that a selected one material of multiple filter materials disposed on a rotating filter wheel that is coupled to the pulsed x-ray source is placed into a path of an x-ray beam produced by the pulsed x-ray source.

In another general aspect, a system includes a pulsed x-ray source, a rotatable wheel having multiple filtering materials mounted in slots, and a processor. The processor is configured to receive an indication of an angular position of the wheel, and to adjust a timing of an occurrence of a pulse from the x-ray source based on the indication of the angular position.

In another general aspect, a rotatable wheel includes multiple filtering materials mounted in slots formed or included in or on the wheel. The rotatable wheel is configured to be coupled to a pulsed x-ray source and to provide an indication of an angular position of the wheel to the x-ray source such that a timing of a pulse from the pulsed x-ray source is determined based on the angular position.

Implementations of the techniques discussed above may include a method or process, a system or apparatus, a device, a filter wheel, a filter drum, or computer software on a computer-accessible and/or machine readable medium.

DETAILED DESCRIPTION

Figure 1:
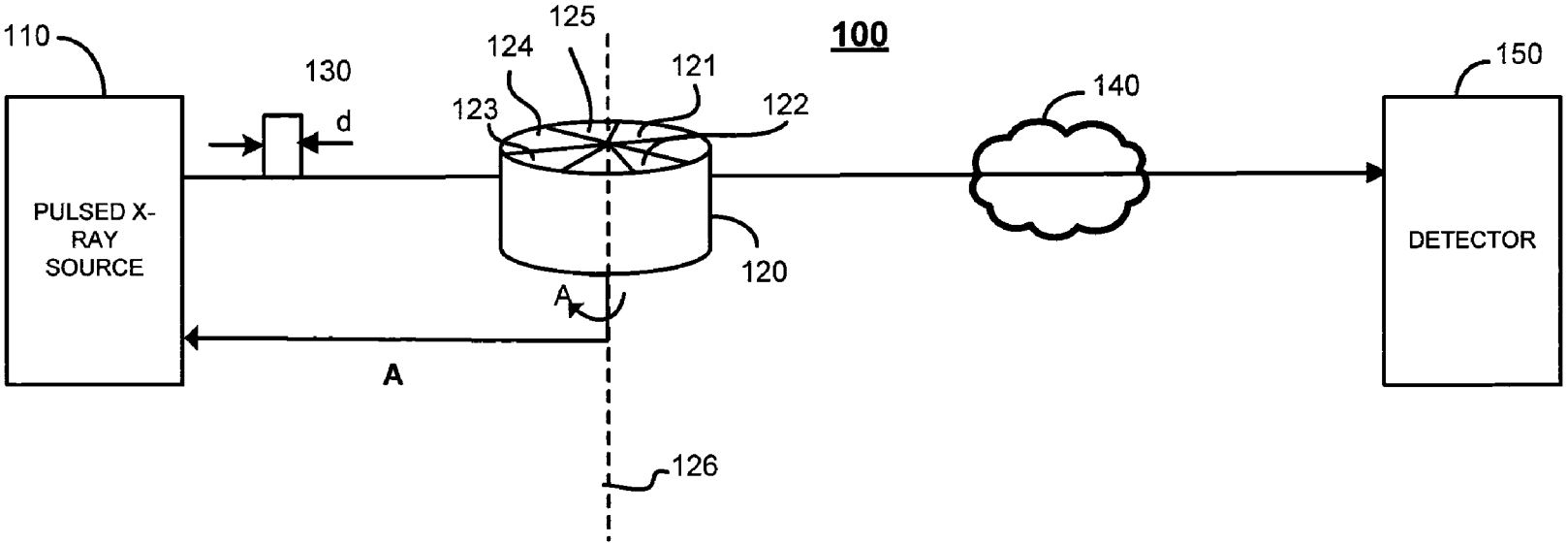
FIG. 1 shows an example system that includes a source of pulsed radiation and a filter wheel.

Referring to FIG. 1, a system 100 includes a pulsed x-ray source 110 (such as a linac) and a rotating filter wheel 120. The filter wheel 120 also may be referred to as a filter drum. The rotating filter wheel 120 includes multiple filtering materials 121-125, one of which is in the path of a pulse 130 emitted from the x-ray source 110 at a given time. Passing the pulse 130 through any of the filtering materials 121-125 changes an intensity and/or an energy spectrum of the pulse 130. The pulse 130 has a time duration "d," and the pulse 130 occurs at a particular time with respect to other pulses in a train of pulses produced by the source 110. The train of pulses has a frequency that nominally determines when a particular pulse is emitted from the source 110. For example, the duration of the pulse 130 may be 3 microseconds (μs) and the time between pulses in the pulse train may be 3 milliseconds (ms). By delaying or advancing the time at which the pulse 130 occurs relative to an angular position (A) of the filter wheel 120, a particular one of the materials 121-125 is selected to filter the pulse 130. In other words, the timing of the occurrence of the emission of the pulse 130 from the x-ray source 110 or the phasing of the pulse 130 is determined by the angular position (A) of the rotating filter wheel 120.

In particular, the x-ray source 110 emits the pulse 130 at a time when a particular one of the materials 121-125 is in the path of the pulse 130 as determined by the measured angular position (A) of the filter wheel 120. Accordingly, the pulse 130 may be filtered by any one of the filtering materials 121-125 by selecting, controlling, and/or regulating the time at which the pulse 130 is emitted from the x-ray source 110.

Thus, the techniques discussed below allow a particular filter to be selected (or no filter at all) by synchronizing the timing of the emission of pulse 130 from the pulsed x-ray source 110 with the angular position of the rotating filter wheel 120. Synchronizing the timing of the pulse 130 with the angular position of the wheel 120 allows the pulse 130 to be emitted from the source 110 at a time in which a particular one of the materials 121-125 is in the path of the pulse 130. Accordingly, the synchronization allows one of the materials 121-125 to be selected as the material to filter the pulse 130.

The rotating filter wheel 120 may be used with the pulsed x-ray source 110 for material discrimination, calibration of the x-ray source 110, and/or testing of the x-ray source 110.

In some implementations, the filter wheel 120 may be part of a system that performs material discrimination. Material discrimination may be performed by determining the effective atomic number (Z) of an object 140 that is exposed to relatively high-energy x-ray radiation and relatively low-energy x-ray radiation. However, the ability to perform material discrimination is dependent on the amount of material and/or the density of the material of object 140. When the material is relatively thick and/or dense, relatively few low-energy x-ray photons pass through the material to reach a detector 150. Because little low-energy x-ray radiation reaches the detector 150, there may not be enough signal from the lower energy x-ray radiation to perform material discrimination. In these cases, allowing the pulse 130 to reach the object 140 without being filtered may produce better results because more x-ray energy reaches the object 140 (thus maximizing penetration of the object 140). Thus, in these cases, the timing of the pulse 130 is adjusted, regulated, or otherwise controlled such that the pulse 130 is emitted from the source 110 at a time when the angular position (A) of the filter wheel 120 is such that a blank region is in the path of the x-ray beam. Additionally, an optimal filtering material may depend on the type of material present in the object 140. The rotating filter wheel 120 allows selection from among the various materials 121-125 by timing the pulse 130 to be emitted when a particular material is in the path of the beam.

The system 100 also may be used for calibration of the x-ray source 110 and/or the detector 150. For example, calibration of the x-ray source 110 and/or the detector 150 may be performed by confirming that the energy of the x-ray beam from the X-ray source 110 is as expected. Such a determination may be achieved by measuring the amount of attenuation of the pulse 130 resulting from the pulse 130 passing through various calibration objects. The calibration objects may be mounted on the filter wheel 120 in the same manner as the filtering materials 121-125 are mounted on the filter wheel 120. In some implementations, the filter wheel 120 includes blank sections that do not include any material at all. Selecting to pass the pulse 130 through a blank section may allow testing of the source 110. For example, passing the pulse 130 through a blank section and measuring the flux of the pulse at the detector 150 provides an indication of whether the source 110 is working properly and producing an expected amount of energy.

Thus, by controlling the timing of the pulses from the x-ray source 110 with the angular position (A) of the filter wheel 120, one of a range of filtering materials or calibration objects may be introduced into the x-ray beam without operator intervention. Additionally, by adjusting the timing of the pulse 130, the filtering material or calibration objects may be changed between pulses from the x-ray source 110. In some implementations, the materials 121-125 include materials that do not filter the pulse 130.

As shown in FIG. 1, the rotating filter wheel 120 (or other rotating, movable, and/or positionable device that holds the filtering materials 121-125) is positioned in the vicinity of the x-ray source 110. An axis of rotation 126 of the filter wheel 120 is such that one of a multiple different materials or objects may be introduced into the beam from the source 110 depending on the angular position (A) of the filter wheel 120. In some implementations, synchronizing or otherwise correlating the rotation of the filter wheel 120 with the pulse rate of the source 110 is used to introduce the same object into the beam during each pulse. For example, by rotating the filter wheel 120 at a rate that is half of the pulse frequency of the beam from the source 110, a different object may be aligned with the beam every other pulse. The rotation rate of the filter wheel 120 may be adjusted so that the same type of material is in the beam two or more times per revolution.

The x-ray source 110 may be a linac. The pulses from a linac are short enough to allow several filter materials or calibration objects 121-125 to be positioned on the rotating filter wheel 120 such that only one of the materials or objects is in the path of the x-ray beam at the time at which the pulse 130 is emitted from the source 110. Different objects may be selected by changing the timing of the pulse 130 based on the angular position (A) of the rotating filter wheel 120. The timing change to select a particular filter material may be relatively slight. For example, the pulse 130 may be a linac pulse that is about 3-μs long whereas the time between pulses is about 3-ms. Because the filter wheel 120 is rotating, the time of occurrence of the 3-μs duration pulse within the 3-ms period determines through which material the pulse 130 passes. Because the pulse 130 is short, the filter objects can be therefore be thin with respect to the circumference of the rotating wheel 120. Thus, only a small change in angular position (A) of the filter wheel 120 is needed to select a different material.

The x-ray source 110 may be triggered by an external signal that determines when the pulse 130 occurs and/or causes emission of the pulse 130. For example, basing the external trigger signal on the angular position (A) of the rotating wheel 120 allows the linac to be triggered using the angular position (A). Synchronization between the linac and the rotating wheel may be achieved by, for example, the use of a shaft encoder or similar mechanism. The output of the shaft encoder may be used to generate a trigger pulse that causes emission of the pulse 130 at a particular angular position (A) of the rotating wheel 120.

As discussed above, a relatively small change in the timing of the emission of the pulse 130 results in selection of a different filter. Thus, the filtering of the x-ray beam from the source 110 may be modified pulse-by-pulse in response to a signal obtained from the detector 150 during the previous pulse or earlier pulses. This may allow the imaging of the object 140 to be optimized even if the nature of the object 140 being examined varied. For example, the object 140 may be a shipping container containing cargo that is part high-dense material and part low-density material. An unfiltered beam may be applied to the high-density cargo in order to obtain maximum penetration. The unfiltered beam is produced by timing the pulse 130 from the source 110 to occur when the angular position (A) of the filter wheel is such that a blank section is in the path of the beam from the source 110. In contrast, when the low-density material is imaged, the timing of the pulses from the source 110 is set such that the pulses alternate between passing through two different filtering materials to produce low-energy x-rays and high-energy x-rays that may be used to perform material discrimination on the low-density portion of the cargo.

In some implementations, a precise amount of filtration may be beneficial. In these implementations, each filter material or calibration object is wide enough in a direction along a circumference of the filter wheel 120 to maintain the same thickness in the beam for the duration of the x-ray pulse 130. In some implementations, a greater variety of filter options may be provided by using filter materials or calibration objects that vary in thickness with rotation angle. In these implementations, the average thickness of the filtering material or calibration object during the pulse 130 depends on the timing of the pulse 130 with respect to the angular position. Such an approach may allow a greater choice of filter thicknesses; however, the exact amount of filtration depends on when the x-ray pulse 130 is triggered with respect to the angular position (A) of the rotating filter wheel 120.

Figure 2A:
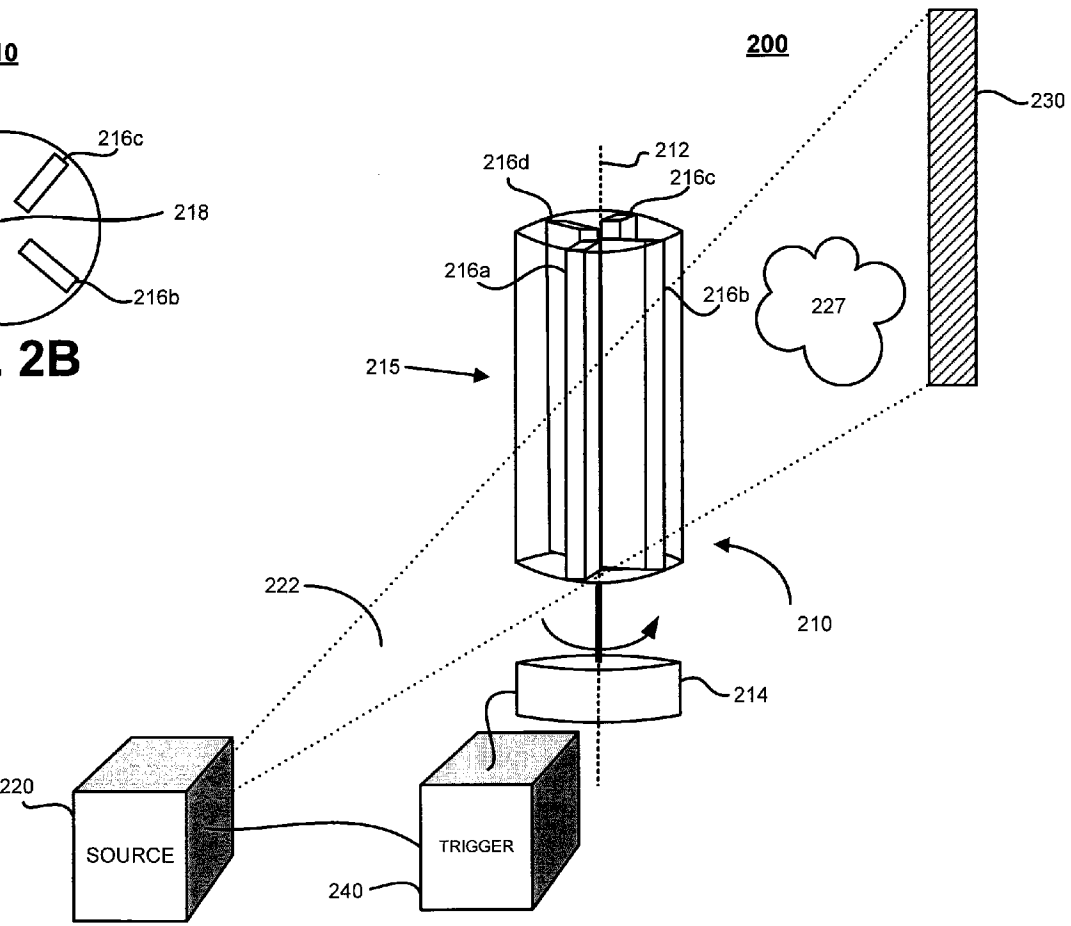
FIG. 2A shows an example system that includes a source of pulsed radiation and a filter wheel.
Figure 2B:
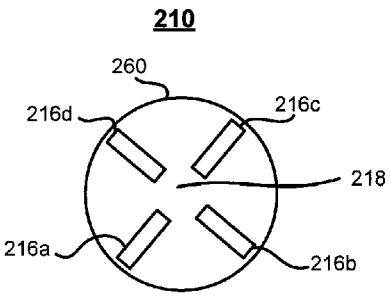
FIG. 2B shows a top view of the filter wheel of FIG. 2A.

FIG. 2A shows an example of a system that includes a source of pulsed radiation and a rotating filter wheel, and FIG. 2B shows a top view of the rotating filter wheel.

The system 200 includes a rotating filter drum 210, a source of radiation 220 that emits a pulse that propagates along a path 222, an object to be imaged 227, and detectors 230. In the example shown, the filter drum 210 is cylindrical and defines a longitudinal axis 212 about which the filter drum 210 rotates. The filter drum 210 includes a portion 215 that includes four sections 216*a*-216*d*, each of which includes a material. In this example, each of the sections 216*a*-216*d* includes a material that runs along the longitudinal axis 212, and the material may be referred to as a vane.

The materials of the sections 216*a*-216*d* each have physical properties that may cause alteration of a pulse that interacts with the material. The effect, or lack of effect, that a material has on the parameters of a pulse with which it interacts may be referred to as a filtering characteristic of that material. For example, interaction with the material may cause an energy spectrum of the pulse to be filtered such that certain energies present in the original pulse are no longer present or are diminished in the filtered pulse. Additionally or alternatively, interaction with the material may cause a decrease in the magnitude of energy present in the pulse. In some implementations, interaction with the material may cause a change in a position or path of the pulse or in an amount of collimation of the pulse. The filtering characteristic of a material may be such that the material does not alter one or more parameters of radiation that interacts with the material. Thus, the materials of the vanes may cause no alterations to incident pulses. In some implementations, the vanes may be blank vanes that do not include a material at all In the filter drum 210, the sections 216*a*-216*d* are uniformly spaced about the circumference of the drum 210 with sections 216*a* and 216*c* opposing each other and sections

216*b* and 216*d* opposing each other. Thus, when section 216*a* is in the path 222 of the pulse, section 216*c* is also in the path 222, and the pulse passes through and/or interacts with the materials of both section 216*a* and section 216*c*. In some implementations, each of the sections 216*a* and 216*c* may include the same material. Each of the sections 216*a*-216*d* may include a different material such that the sections 216*a*-216*d* are each associated with a different filtering characteristic. The amount of alteration caused by interactions between the pulse and the material for a particular material may vary with the thickness of the material. In some implementations, the thickness of the material along the direction of propagation of a pulse of radiation varies. In some implementations, one or more of the sections 216*a*-216*d* may include no material at all. Sections without material may be referred to as blank sections. In some implementations and in the example shown in FIG. 2A, the pulse expands rapidly after emission from the source 220, and the vanes are longer in the direction of the longitudinal axis 212 than in the horizontal axis such that the entire pulse interacts with the vane.

The materials used in the vanes may include plastics, which filter radiation to remove the low end of the energy spectrum, and/or metals, such as aluminum, which have a relatively constant attenuation across the energy spectrum.

An angular position of the filter drum 210 is measured by a sensor 214. The sensor 214 produces an indication of the angular position and provides the indication to a trigger pulse generator 240. The indication of the angular position may be, for example, an electronic signal having an encoded value or a signal level that represents the angular position of the drum 210 at a particular time. The sensor 214 may monitor the angular position of the drum 210 continuously, at a preset interval, or at particular times selected by an operator or preset in the sensor 214.

The trigger pulse generator 240 receives the indication of the angular position from the sensor 214 and generates a trigger pulse sufficient to cause the source 220 to emit a pulse of radiation. In some implementations, the trigger pulse generator 240 only generates the trigger pulse when the indication shows that the angular position of the drum 210 is equal to a particular value or falls within a range of values. In this manner, the source 220 is only triggered when the drum 210 is in a position which results in a desired one of the sections 216*a*-216*d* being in the path 222 of the pulse. In some implementations, the trigger pulse is a pulse that causes the source 220 to delay the emission of a pulse slightly such that the pulse, once emitted, strikes one of the sections 216*a*-216*d* that is selected based on the indication of angular position of the drum 210 and placement of the selected one of the sections in the path of the pulse due to the motion of the drum 210.

Referring to FIG. 2B, a top view of the filter drum 210 is shown. As seen from the top of the drum 210, the sections 216*a* and 216*c* are arranged along a line and the sections 216*b* and 216*d* are arranged along a line. In the example shown, a gap 218 is formed in the middle of the drum 210. The gap 218 is a region without material through which the pulse propagates without striking any of the sections 216*a*-216*d*. Thus, the gap 218 allows the drum 210 to be positioned such that the pulse passes through the drum 210 without passing through any of the sections 216*a*-216*d*.

In the example shown, a frame 260 supports the vanes and holds them in place. In other examples, the vanes may be supported by a housing (not shown) that forms an outer surface of the drum 210 and is centered on the longitudinal axis 212. The housing may be made from a material that is penetrated by the radiation emitted from the source.

Although in the example of FIG. 2A, the trigger pulse generator 240 is shown as being in communication with but physically separate from the drum 210, the source 220, and the sensor 214, this is not necessarily the case. In some implementations, the trigger pulse generator 240 may be part of the source 220 while still being electronically coupled to the sensor 214. In some implementations, the trigger pulse generator 240 may be part of the sensor 214. The sensor 214 may be permanently affixed to the drum 210 or the sensor 214 may be a separate component that is removable from the drum 210. The source 214 may be referred to as an element that produces an indication of the position of the drum 210.

Figure 3:
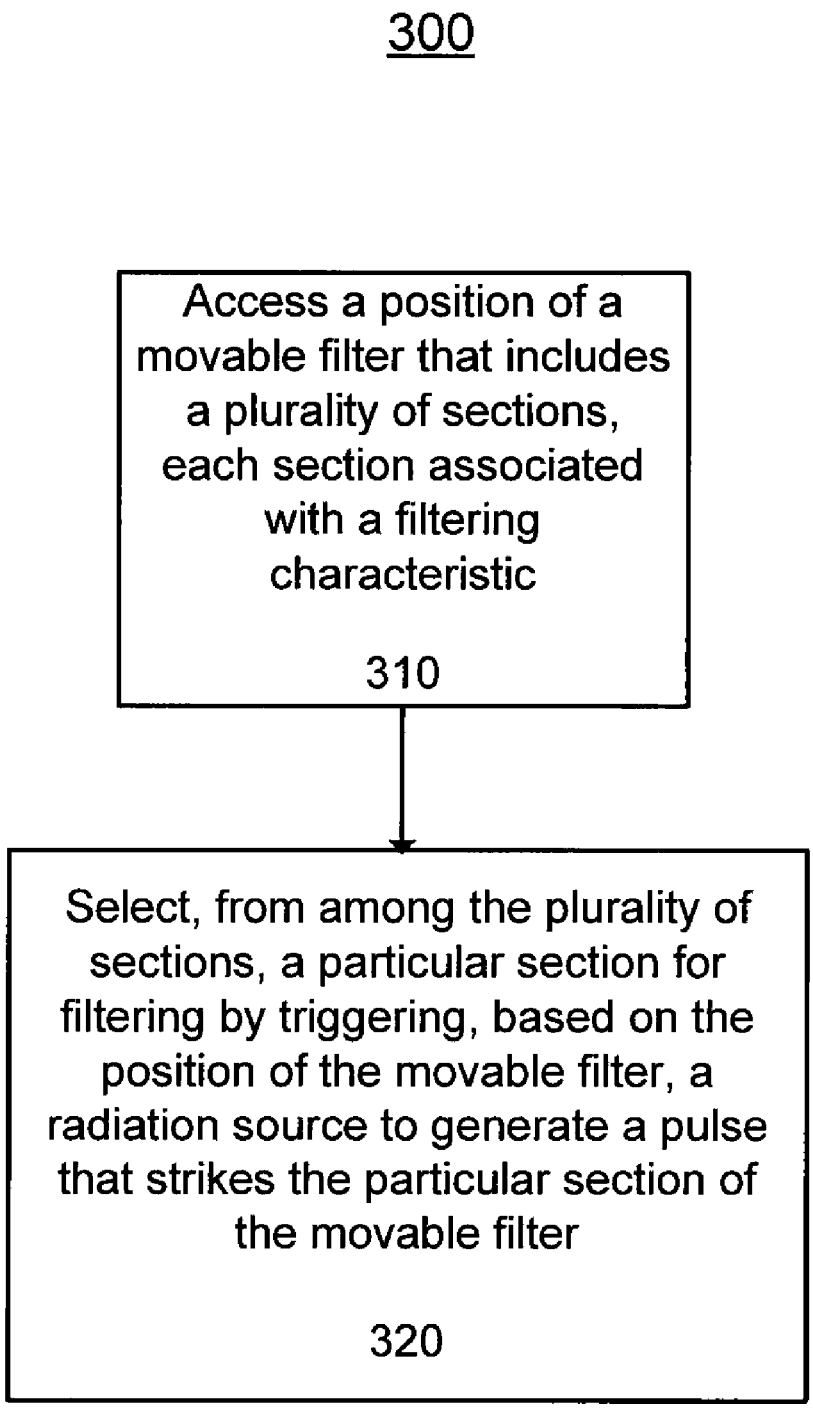
FIG. 3 is an example process for filtering a pulse of radiation.

Referring to FIG. 3, an example process for filtering a pulse of radiation is shown. The process 300 may be performed on one or more processors included in the trigger pulse generator 240, the sensor 214, and/or the source 220. The one or more processors may be processors suitable for the execution of a computer program such as a general or special purpose microprocessor, and any one or more processors of any kind of digital computer. Generally, a processor receives instructions and data from a read-only memory or a random access memory or both. The processor may be electronically coupled to an electronic storage, such as a computer-readable or machine-readable medium, that stores or otherwise includes instructions, that when executed, cause the processor to perform the process 300.

A position of a movable filter that includes a plurality of sections, each of which are associated with a filtering characteristic, is accessed (310). The movable filter may be the filter drum 210 discussed above, and the sections may be the sections 216*a*-216*d*. In some implementations, the moveable filter is a moving filter and the motion of the filter and the sections may be constant, or nearly constant. The motion of the filter may be angular motion about an axis of rotation. In some implementations, the filter may have linear motion, for example, the filter and the sections may move laterally along a direction perpendicular to the direction of propagation of the pulse and/or the filter may move along a direction parallel to the direction of propagation of the pulse.

In some implementations, the movable filter may be stationary for a finite amount of time. For example, the drum 210 may be rotated to place the sections 216*a* and 216*c* in the path of the pulse, the drum 210 may remain stationary while one or more pulses interact with the sections 216*a* and 216*c*, and then the drum 210 may be rotated to place sections 216*b* and 216*d* in the path of the pulse. In other implementations, the drum 210 may be rotated such that different a different section is moved into the path of the pulse between successive pulses emitted from the source 220.

The position of the filter may be accessed by accessing an indication of the position measured by the sensor 214 and stored in an electronic storage in communication with the sensor 214, and/or the position of the filter may be accessed by receiving the indication of the position measured by the sensor 214. The indication of position may be, for example, a numeric value representing the angular position of the filter drum 210.

A particular section for filtering the pulse is selected from among the plurality of sections (320). The particular section is selected by triggering a radiation source, based on the position of the filter, to emit a pulse of radiation. The section may be selected based on the position of the filter, by, for example, generating a trigger pulse when the position of the filter indicates that a desired section is in the path of the pulse, or will, accounting for motion of the filter, be in the path of the pulse. Thus, the selection of the section is based on the presence of the section in the path of the pulse. Accordingly, the selection of the section depends on adjusting the timing of an emission of a pulse from the source and is independent of an energy or other parameter of the pulse or the source.

Other implementations are within the scope of the following claims. For example, the source of pulsed radiation may be a source of neutrons. The sensor 214 may be a position sensor. In some implementations, the sensor 214 is an integral element of the drum 210. The output signal of the sensor may be provided directly to the source of pulsed radiation. The drum 210 may include more or fewer sections than the four sections 216*a*-216*d* shown in FIGS. 2A and 2B. The sections in the drum 210 may be arranged irregularly about the circumference of the drum rather than being uniformly placed about the circumference such that placement of one section in the path 222 does not result in placement of a section in the path 222. The axis of rotation of the filter wheel 120 may be parallel with the direction of propagation of the pulse 130.

What is claimed is:

1. A system comprising:

a source of pulsed radiation; and a positionable filter coupled to the source of pulsed radiation, the positionable filter comprising an element that produces an indication of a position of the filter, wherein the source is configured to receive the indication of the position of the filter, and to regulate emission of a pulse of radiation based on the indication.

2. The system of claim 1, wherein the filter comprises a portion, the portion comprising a material that causes alteration of one or more of a flux, energy spectrum, position, or collimation of a beam of radiation that interacts with the material.

3. The system of claim 2, wherein the portion comprises a plurality of sections, at least one of which comprises the material.

4. The system of claim 3, wherein at least one of the plurality of sections is a blank section without the material such that a beam of radiation is unaltered as a result of interacting with the blank section.

5. The system of claim 3, wherein at least one section comprises a second material different from the material.

6. The system of claim 1, wherein the source of pulsed radiation regulates emission of the pulse of radiation by determining a particular time to emit the pulse of radiation.

7. The system of claim 4, wherein the positionable filter rotates about an axis of rotation such that a pulse emitted from the source strikes one of the plurality of sections at a particular time.

8. The system of claim 7, wherein the source of pulsed radiation regulates emission of the pulse of radiation by delaying emission of the pulse of radiation such that the emitted pulse strikes a selected one of the plurality of sections.

9. The system of claim 1, wherein the source of pulsed radiation is a linear accelerator.

10. A device comprising:

an area comprising a material that alters a parameter of a beam of radiation that interacts with the material, the device being configured to move relative to a source of pulsed radiation; and an element that provides a signal to the source of pulsed radiation indicating a position of the area relative to the source, the signal causing the source to trigger emission of a pulse at a time such that the emitted pulse is incident upon a portion of the area.

11. The device of claim 10, wherein the device is configured to rotate about an axis of rotation, and the indication of a position of the device comprises an indication of an angular position of the device relative to the axis of rotation.

12. The device of claim 11, wherein the device comprises a cylindrically shaped element defining a longitudinal axis parallel to the axis of rotation, the cylindrically shaped element comprises a first end and a second end, and the portion comprising the material is oriented between the first and second ends and along the longitudinal axis.

13. The device of claim 10, wherein the portion comprising a material comprises a plurality of sections at least one of which is a blank section that does not include a material such that an emitted pulse is unaltered by interaction with the blank section.

14. The device of claim 13, wherein the signal causes the source to delay the emission of the pulse such that the pulse is emitted when a selected one of the plurality of sections is in a path of the emitted pulse.

15. The device of claim 10, wherein the signal is sufficient to cause the source to alter a timing of the emission of the pulse from the source.

16. A method of filtering a pulse of radiation, the method comprising:

accessing a position of a movable filter that comprises a plurality of sections, each section associated with a filtering characteristic; and selecting, from among the plurality of sections, a particular section for filtering by triggering, based on the position of the movable filter, a radiation source to generate a pulse that strikes the particular section of the movable filter.

17. The method of claim 16, wherein selecting from among the plurality of sections comprises selecting a section associated with a filtering characteristic that does not alter a parameter of the pulse.

18. The method of claim 16, wherein accessing a position of the movable filter comprises receiving an indication of the position of the movable filter generated by the movable filter.

19. The method of claim 18, wherein the movable filter rotates about an axis of rotation, and wherein accessing a position of the movable filter comprises receiving an angular position of the filter.

20. The method of claim 16, wherein the particular section is selected independently of an energy output of from source.

21. A machine readable medium coupled to an electronic processor, the medium comprising instructions that, when executed, cause the processor to perform operations comprising:

accessing a position of a moving filter that comprises a plurality of sections, each section associated with a filtering characteristic;

determining, based on the position, a time at which a particular one of the plurality of sections is in the path of a pulsed radiation source; and generating a signal sufficient to cause the source to emit a pulse such that the pulse strikes the particular one of the plurality of sections.

22. The medium of claim 21, further comprising instructions to cause the processor to provide the signal to the source.

23. The medium of claim 21, wherein the filter rotates about a longitudinal axis defined by the filter, and accessing a position of the filter comprises receiving an indication of an angular position of the filter relative to the longitudinal axis.

* * * * *